United States Patent [19]

Breeck et al.

[11] 4,393,825

[45] Jul. 19, 1983

[54] SYSTEM FOR CONTROLLING FUEL FLOW WITHIN AN INTERNAL COMBUSTION ENGINE

[75] Inventors: Philip L. Breeck; David E. Shultz; Andrew C. Rosselli, all of Columbus, Ind.

[73] Assignee: Cummins Engine Company, Inc., Columbus, Ind.

[21] Appl. No.: 221,768

[22] Filed: Dec. 31, 1980

[51] Int. Cl.[3] ..... F02M 63/02

[52] U.S. Cl. ..... 123/198 F; 123/179 L; 123/481

[58] Field of Search ..... 123/198 F, 198 DB, 481, 123/179 L

[56] References Cited

U.S. PATENT DOCUMENTS

| | | | |
|---|---|---|---|
| 3,240,197 | 3/1966 | Mock | 123/198 F |
| 3,741,685 | 6/1973 | Simko | 123/198 F |
| 3,815,563 | 6/1974 | Stinsa | 123/198 F |
| 3,896,779 | 7/1975 | Omori et al. | 123/198 F |
| 3,902,472 | 9/1975 | Baguelin | 123/198 F |
| 3,976,042 | 8/1976 | Baguelin | 123/179 G |
| 4,071,010 | 1/1978 | Miller | 123/198 F |
| 4,150,651 | 4/1979 | Wade et al. | 123/198 F |
| 4,297,979 | 11/1981 | Kamleitner | 123/198 F |

FOREIGN PATENT DOCUMENTS 666285 6/1979 U.S.S.R. .

*Primary Examiner*—Ira S. Lazarus

*Attorney, Agent, or Firm*—Neuman, Williams, Anderson & Olson

[57] ABSTRACT

A system is provided for controlling fuel flow within an internal combustion engine having a plurality of cylinders. The system includes a fuel source; a fuel pump responsive to the engine speed; and a multimode adjustable control valve connected to the fuel pump and a predetermined number of first cylinders. The control valve, when in a first mode, substantially shutting off fuel flow to the first cylinders, except for a minimal amount of fuel leakage from the valve to the first cylinders for lubricating purposes. When in a second mode, the control valve allows substantial fuel flow to the first cylinders. The control valve assumes its first mode when the operating temperature is below a predetermined amount and/or the engine is operating under a predetermined load.

11 Claims, 15 Drawing Figures

FIG. 1
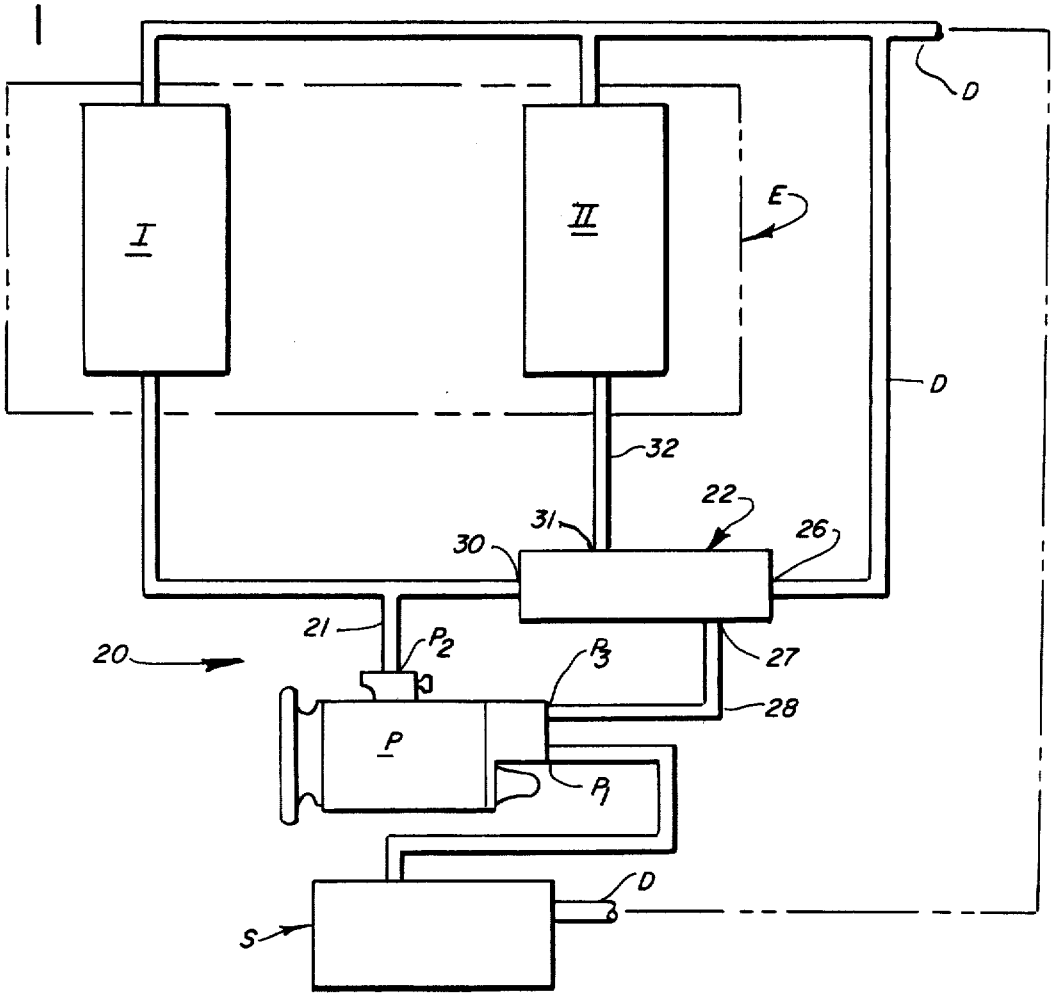
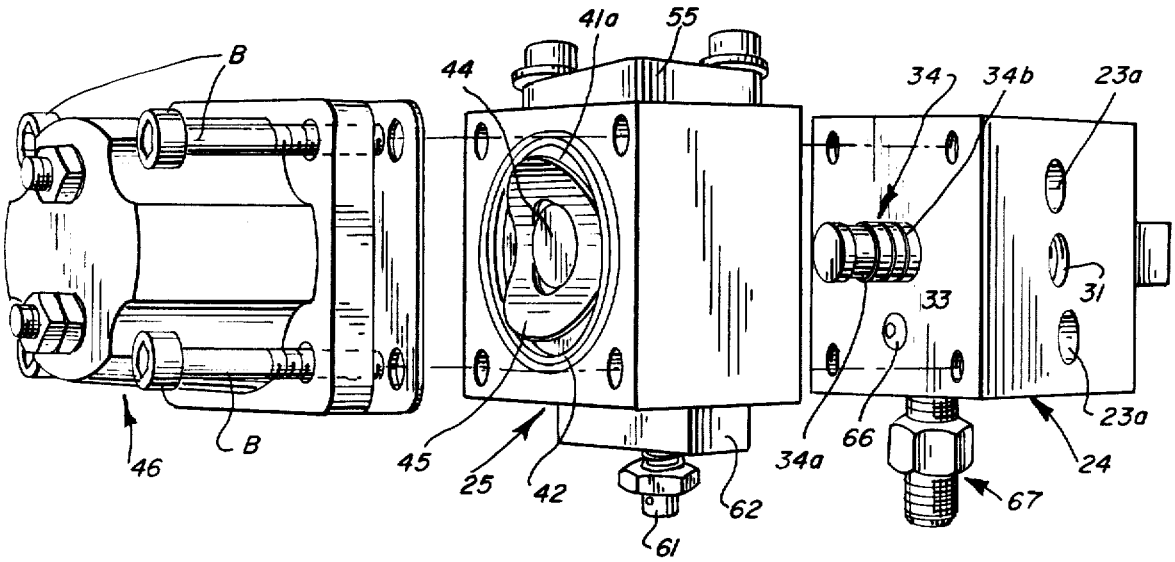
FIG. 2A

FIG. 2B
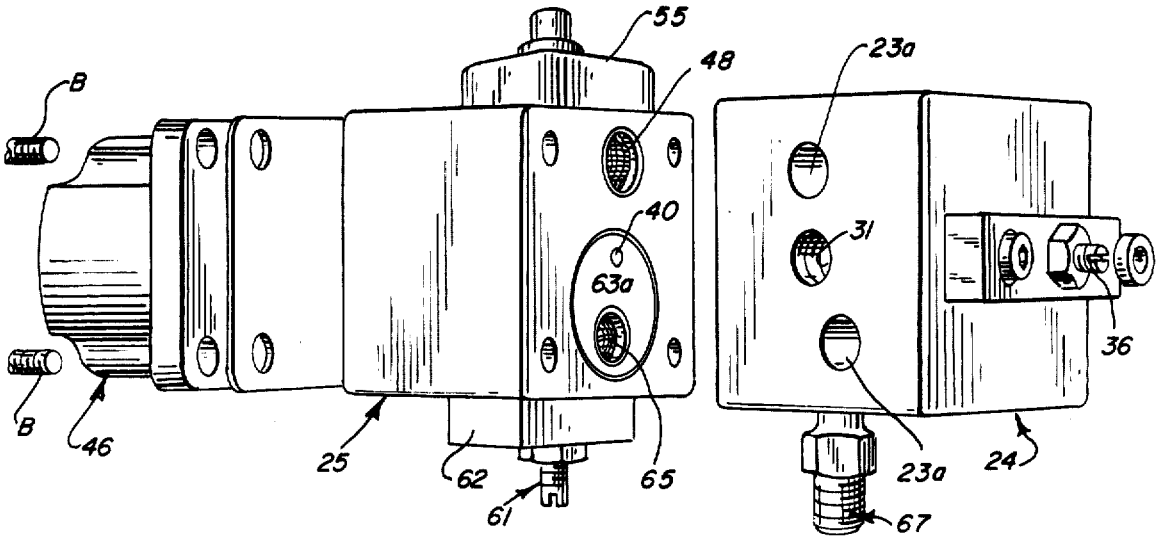
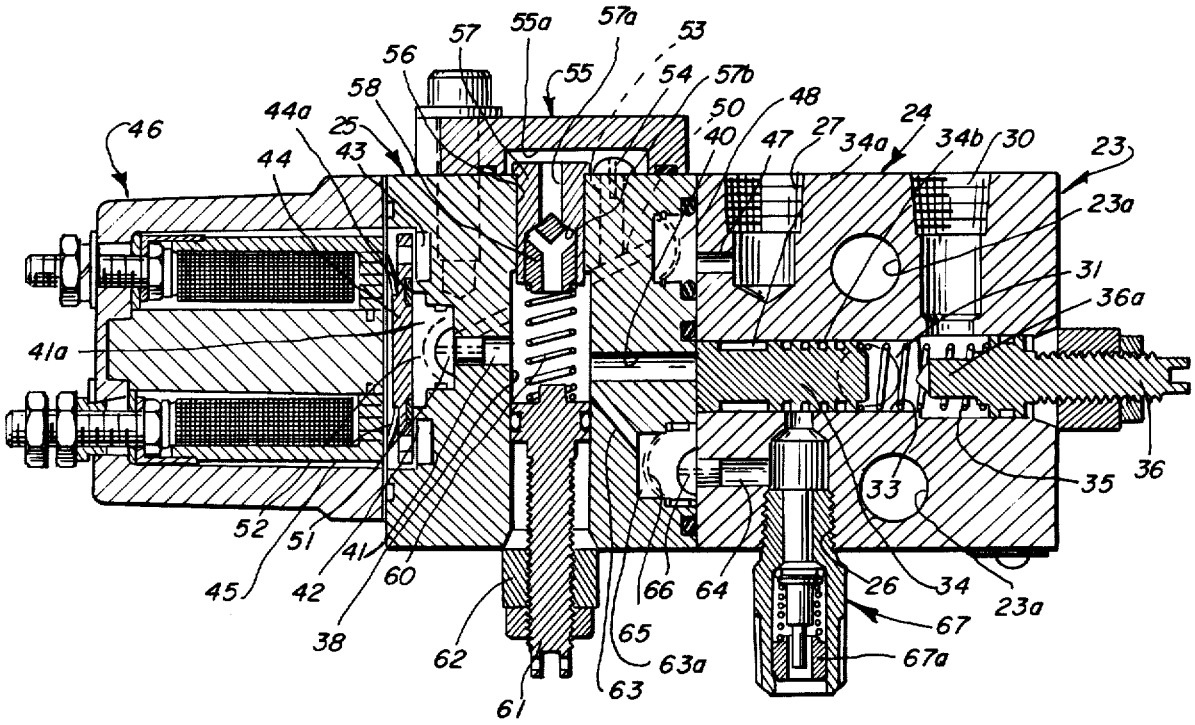
FIG. 2

FIG. 3
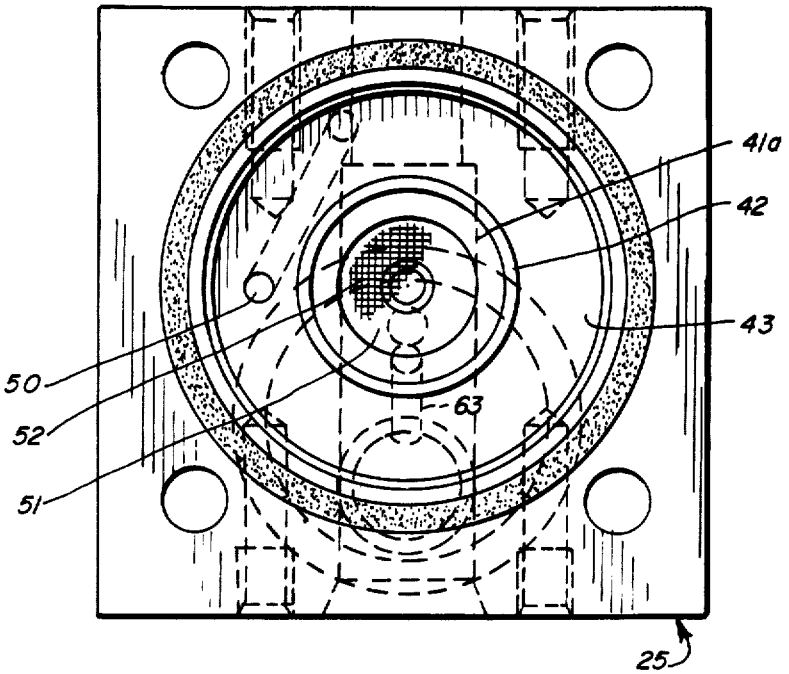
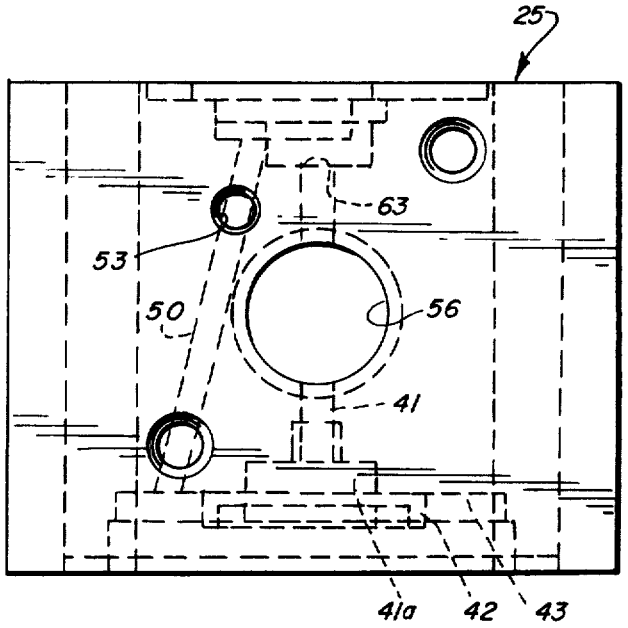
FIG. 4

FIG. 5
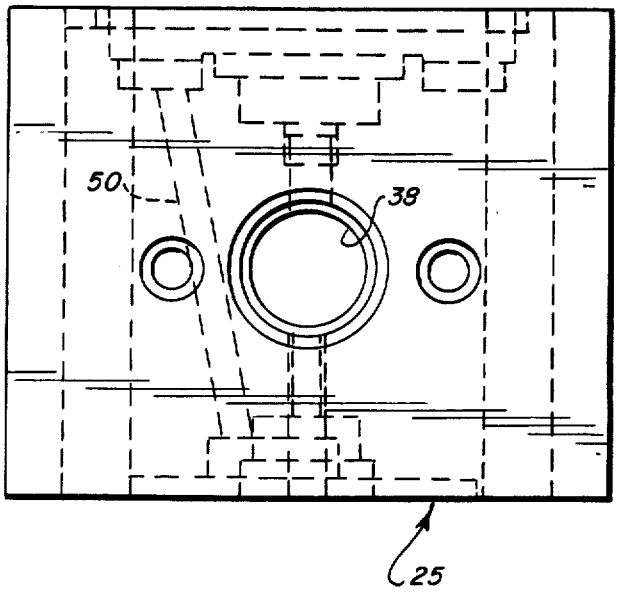
FIG. 6
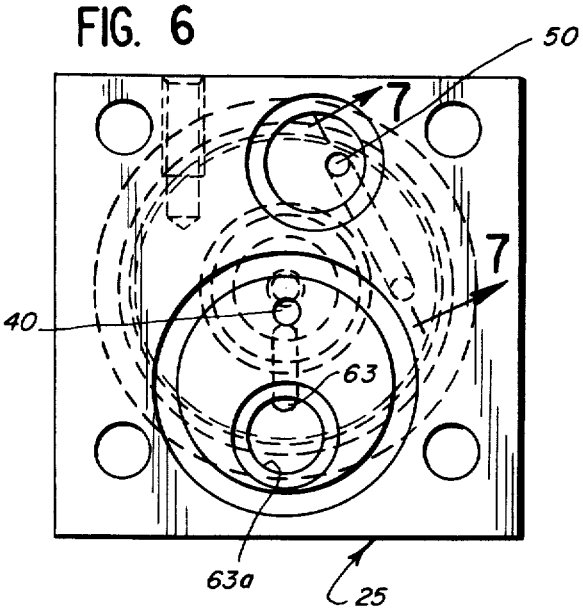
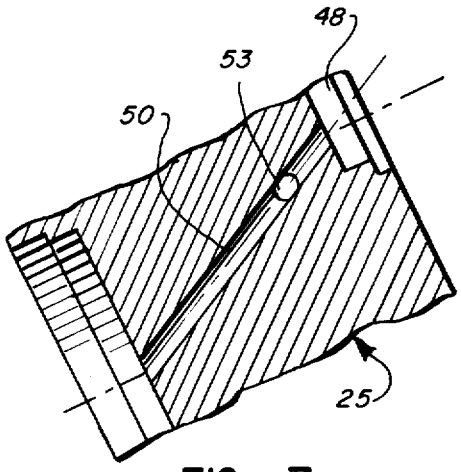
FIG. 7

FIG. 8
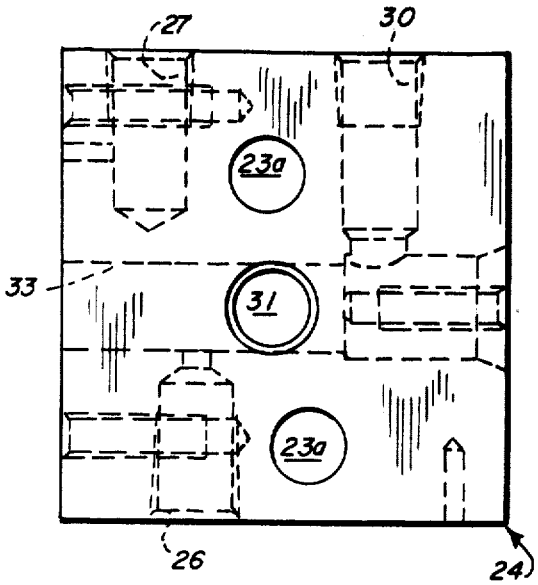
FIG. 10
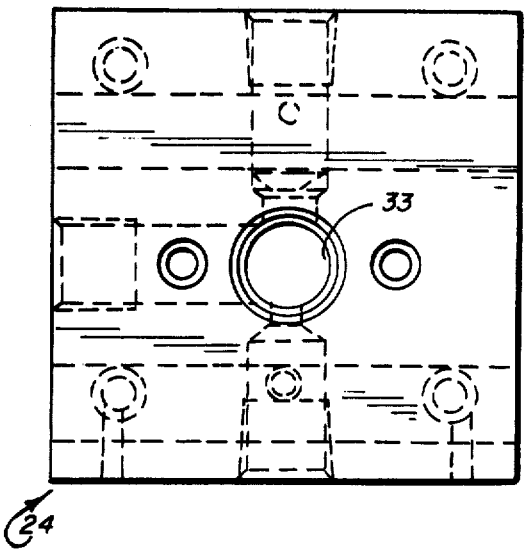
FIG. 9
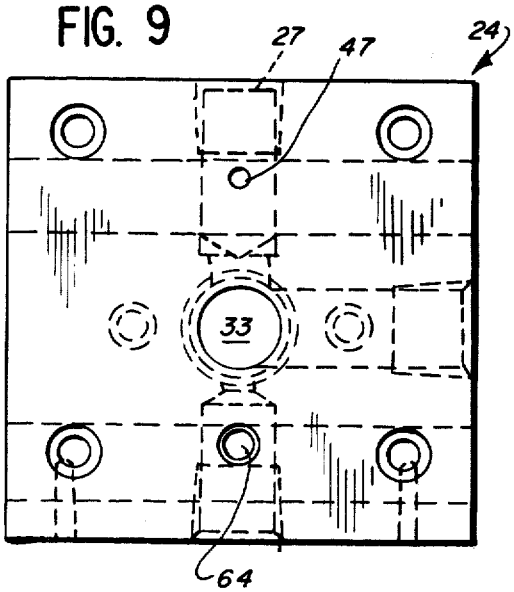
FIG. 11
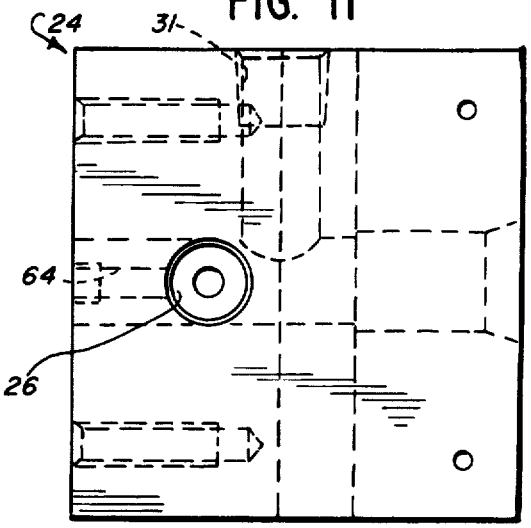
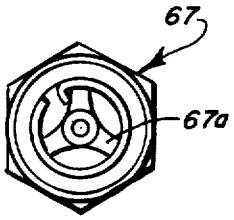
FIG. 12
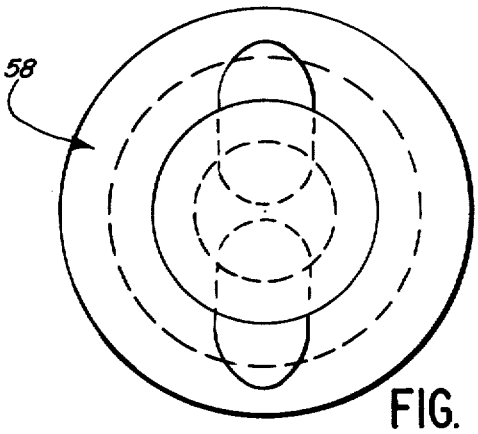
FIG. 13

SYSTEM FOR CONTROLLING FUEL FLOW WITHIN AN INTERNAL COMBUSTION ENGINE

BACKGROUND OF THE INVENTION

The problem of reducing unburned hydrocarbons during certain operating conditions of an internal combustion engine (e.g., diesel) having multi-banks of cylinders has always been difficult to overcome without adversely affecting the overall operational efficiency of the engine.

Various attempts in the past in resolving this problem have been unsuccessful because the prior systems have been beset with one or more of the following shortcomings: (a) the system could not withstand normal endurance test and thus, required an inordinate amount of service and maintenance; (b) the system was not responsive to or reliable under varying operating conditions; (c) the system embodied numerous complex and costly components which were highly susceptible to malfunction; (d) when the fuel flow to one bank of cylinders was shut off, certain components of the one bank cylinders were starved of lubrication and thus, rendered such components highly susceptible to malfunction; (e) the system was not readily capable of being utilized with internal combustion engines which varied in size and horse-power rating over a wide range; and (f) the system was not readily responsive to the load demands imposed on the engine.

SUMMARY OF THE INVENTION

Thus, it is an object of the invention to provide a system of the type described which is not beset with the aforenoted shortcomings.

It is a further object to provide a system which significantly improves the operating efficiency of an internal combustion engine during start-up and under predetermined load conditions.

It is a still further object to provide a system of the type described which may be readily installed in a new or used internal combustion engine.

Further and additional objects will appear from the description, accompanying drawings, and appended claims.

In accordance with one embodiment of the invention, a system is provided for controlling fuel flow within a multi-cylinder internal combustion engine wherein fuel flow to predetermined first cylinders is substantially shut off only during predetermined engine operating conditions. The system includes a fuel source, and a fuel pump responsive to the speed of the engine and having a first outlet connected to a first fuel supply line for predetermined second cylinders and a second outlet. Coacting with the fuel pump is a multi-mode adjustable control valve having a housing provided with a first port connected to a drain line leading to the fuel source; a second port connected to the second outlet of the fuel pump; a third port connected to the first fuel supply line; and a fourth port connected to a second fuel supply line for the first cylinders. When the engine is operating below a predetermined first speed and/or below a predetermined operating temperature, the control valve automatically assumes a first mode wherein fuel flow to the first cylinders is substantially cut off. Once the engine has attained a predetermined operating temperature and/or rail pressure (load), the control valve will automatically assume a second mode wherein there is substantial fuel flow to the first cylinders. While the control valve is in its first mode, there is a small amount of fuel leakage from the control valve to the first cylinders for purposes of lubricating components thereof.

DESCRIPTION

For a more complete understanding of the invention, reference should be made to the drawings, wherein:

FIG. 1 is a fragmentary diagramatic view of one form of the improved system.

FIG. 2 is an enlarged side view in vertical section of one form of control valve embodied in the system shown in FIG. 1.

FIG. 2*a* is a fragmentary perspective left end view of the control valve of FIG. 2 showing certain components thereof in exploded relation.

FIG. 2*b* is similar to FIG. 2*a*, but viewed from the opposite end of the control valve of FIG. 2.

FIG. 3 is an enlarged left end view of the control valve left housing section shown in FIG. 2.

FIG. 4 is a top plan view of the housing section shown in FIG. 3.

FIG. 5 is a bottom view of the housing section shown in FIG. 3.

FIG. 6 is an enlarged fragmentary right end view of the control valve left housing section shown in FIG. 2.

FIG. 7 is an enlarged fragmentary sectional view taken along line 7—7 of FIG. 6.

FIG. 8 is an enlarged side elevational view of the control valve right housing section shown in FIG. 2.

FIG. 9 is a left end view of the control valve right housing section shown in FIG. 2.

FIG. 10 is similar to FIG. 9, but of the right end of the housig section shown in FIG. 8.

FIG. 11 is a bottom view of the housing section shown in FIG. 8.

FIG. 12 is an enlarged bottom view of the drain check valve mounted within one of the ports formed in the housing section of FIG. 8.

FIG. 13 is an enlarged top view of a check valve plunger embodied in the control valve of FIG. 2.

Referring now to the drawings and more particularly to FIG. 1, one form of the improved system 20 is shown in combination with a multi-cylinder internal combustion engine E (e.g., diesel engine). The cylinders in the illustrated embodiment are arranged in two banks I and II. The system 20 includes a fuel pump P of conventional design having an inlet $P_1$ connected to a fuel source S, a first outlet $P_2$ connected to a fuel supply (rail) line 21 leading to the uncontrolled bank I of cylinders, and a second outlet $P_3$. The fuel pump pressure in line 28 varies with engine speed. The fuel pump pressure in line 21 varies as a function of fuel pump throttle position, load demands on the engine, and engine speed.

Coacting with the fuel pump P is a control valve 22 which is automatically adjustable between various modes, as will be described more fully hereinafter. Valve 22, as seen more clearly in FIGS. 2, 2*a*, 2*b*, includes a composite housing 23 which is adapted to be readily mounted on the engine block. Suitable openings 23*a* are provided in the housing to accommodate mounting bolts, not shown. The housing 23 is formed of two sections 24, 25 which are secured to one another in face-to-face relation by a plurality of assembly bolts B. Housing 23 is provided with a first port 26 which is connected to a drain line D leading to the fuel source S. A second port 27 is provided in the housing and is connected to a line 28 which interconnects the pump second outlet $P_3$ and the port 27. A third port 30 is formed in the valve housing and is connected to the rail line 21 for cylinder bank I. Lastly, a fourth port 31 is provided in the housing 23 and is connected to a fuel supply line 32 leading to the cylinder bank II.

Slidably disposed within an internal bore 33 formed in housing section 24 is an elongated piston 34. The piston is biased to the left end of bore 33, as seen in FIG. 2, by a relatively weak spring 35, the tension of which is adjusted by a threadably mounted plug 36.

As will be seen in FIG. 2, bore 33 effects communication between ports 30, 31 when the piston 34 assumes its left terminal, or open, position within bore 33, see FIG. 2. On the other hand, when the piston 34 is disposed at its right terminal, or close, position, not shown,—that is to say when it is in abutting relation with the end 36*a* of plug 36—communication between ports 30, 31 is cut off by piston 34. While communication between ports 30, 31 is cut off when the piston is in its close position, a large annular groove 34*a* formed in the exterior of piston 34 effects restricted communication between ports 26, 31 thereby allowing a limited amount of fuel to leak (flow) to cylinder bank II and effect lubrication of various components thereof (e.g., fuel injector plug) and thus prevent sticking or malfunctioning of the fuel injectors. By adjusting the relative position of plug 36, the amount of fuel leakage to the bank II can be varied. Besides groove 34*a*, the exterior of piston 34 is provided with additional grooves 34*b* which fill with fuel in order to equalize the pressure around the piston circumference and eliminate any possible drag of the piston against the bore (centers the piston in the bore).

The end of bore 33, opposite plug 36 is in communication with an internal cavity 38 through a passageway 40. Both the cavity and passageway are formed in housing section 25. Also communicating with cavity 38 is a passageway 41, the opposite end 41*a* of which terminates at the exterior of housing section 25 and is enlarged and delimited by an annular flange 42. The flange, in turn, is delimited by an annular groove 43 formed in the exterior of housing section 25. Coacting with the flange 42, groove 43 and the enlarged end 41*a* of passageway 41 is a disc-shaped valve piece 44 which is biased by a spring 45 to assume a closed position wherein a seal insert 44*a*, carried on the piece, is in sealing contact with flange 42. The valve piece 44 is substantially formed of magnetic material and is moved to an open position by a solenoid 46 when the latter is electrically energized. The solenoid is mounted on the outer surface of housing section 25.

Energizing of the solenoid is controlled by a thermistor, of conventional design, not shown, which is wired thereto and placed within the engine coolant system downstream of the engine thermostat. When the operating temperature of the engine is below a predetermined amount (e.g., 160° F.) as determined by the temperature of the circulating coolant, the valve piece 44 will assume an open position, allowing the fuel to flow through line 28 and exert a predetermined pressure on piston 34 causing same to assume the right terminal or close position in bore 33. The predetermined pressure must be greater than the combined pressure of the bias spring 35 and the fuel supply line pressure exerted on the opposite end of piston 34.

The fuel flow from line 28 enters the valve housing section 24 at port 27 and then passes through a short internal passageway 47, formed in housing section 24 and past a filter 48 which is located at one end of an internal by-pass passageway 50 formed in valve housing 25. The opposite end of the by-pass passageway terminates at the groove 43 which encompasses the flange 42.

In order to prevent an excessive fuel flow within cavity 38, when the valve piece 44 assumes its open position, a pressure-reducing orifice 51 is positioned at the end of passageway 41. In addition to the orifice 51, a second filter 52 may also be positioned upstream thereof.

Also communicating with the by-pass passageway 50 is a passageway 53 which has one end terminating at the exterior of valve housing section 25. A pressure-reducing orifice 54 is positioned within passageway 53.

Mounted on the exterior of housing section 25 and overlying the end of passageway 53 is a cap piece 55, see FIG. 2. Cap piece 55 is provided with a recess 55*a* which bridges the distance between the orificed end of passageway 53 and the upper end of an internal passageway 56 formed in the housing section 25. The opposite end of passageway 56 terminates at cavity 38. Snugly positioned within passageway 56 is an adaptor sleeve 57 having a center bore 57*a*, the diameter of which approximates that of passageway 53. The end of bore 57*a*, adjacent cavity 38, is counterbored and forms a seat 57*b* for a valve plunger 58. The plunger is biased by a spring 60, disposed within the cavity, to engage seat 57*b* and close off the communication between the adaptor sleeve bore 57*a* and the cavity 38. The tension of spring 60 may be varied by an elongated stem piece 61 disposed within the lower end of the cavity and threadably mounted on a bar 62, the latter being fixedly secured to the underside of housing section 25.

As seen in FIG. 2, cavity 38 has a lower portion thereof connected to one end of an internal passageway 63 formed in the housing section 25. The opposite end 63*a* of passageway 63 is enlarged and communicates with a passageway 64 formed in housing section 24. Passageway 64, in turn, communicates with the drain port 26 formed in housing section 24. Disposed within the enlarged end 63*a* of passageway 63 is a filter 65. A flow-reducing orifice 66 is positioned within passageway 64.

Threadably mounted within the drain port 26 is a check valve 67 providing a fixed back pressure (e.g., 3 p.s.i.) in drain port 26 and acting as the pressure source for the limited amount of fuel leakage (flow), which flows through annular groove 34*a* for lubrication of the injectors.

Through proper sizing of orifices 54 and 66 and the careful adjustment of the bias pressure exerted on plunger 58 by spring 60, the cracking (opening) pressure necessary to move piston 34 from its right terminal position to its left terminal position can be carefully controlled. Thus, the cracking pressure will be responsive to the speed of the engine, because port 27 is connected to line 28 and the pressure within the line is directly affected by the speed of the fuel pump P.

From the foregoing description of the control valve 22, it will be noted that said valve operates by a system of pressure balances which act on the sliding piston 34 to either open or close the fuel supply line 32 to the (controlled) bank II of cylinders. The pressure from rail line 21 acts on the right side of piston 34 (as seen in FIG. 2) and slides the latter to its open position. Movement of the piston to its open position is resisted by the pump pressure existing in line 28, which is reduced through a series of orifices 51–66 and 54–66. The reduced pressure may be defined as a bias pressure.

When the engine throttle, not shown, is closed, the pressure in rail line 21 drops off causing the piston 34 to be moved to the right or close position by the bias pressure, whereby the fuel supply, except for leakage, is cut off to cylinder bank II. Subsequently, as the engine throttle is opened, pressure in the rail line 21 begins to increase until it becomes greater than the bias pressure whereby piston 34 is forced to its left, or open, position, as seen in FIG. 2. When in this latter position, fuel is supplied to bank II while continuing to be supplied to the bank I. Since the fuel pump pressure in line 28 varies in proportion to the engine speed, the opening, or cracking, pressure required to effect movement of the piston 34 to its open position will also vary with the engine speed. By reason of this fact, a more accurate control of the engine load at which the transition occurs from a one bank to a two bank operation can be obtained. Thus, the cracking pressure can be turned to whatever pressure is desired by adjusting the ratio of the orifices 51-66 and 54-66 on the bias pressure side (left side) of piston 34.

One of the major advantages of the improved system 20 is that it allows the engine, when at idle, to be operating on either selected cylinders or on all cylinders, depending on the temperature of the engine coolant. When the engine is cold and at idle, excessive exhaust hydrocarbon emissions would occur if both cylinder banks were operating; thus, by having the engine on only one bank operation under these conditions, the hydrocarbon emissions are reduced.

When the engine reaches its normal operating temperature, the improved system allows the engine, when at idle, to automatically resume its two bank operation and thereby (a) allow the engine to readily carry the high accessory loads at idle and (b) eliminate the excessive engine vibration which would normally occur with a one bank idle operation.

In order to allow the engine to idle on a two bank mode—that is when the coolant has reached a predetermined temperature (e.g., 160° F.) and valve piece 44 assumes a close position—it is necessary to eliminate the bias pressure at idle speed which would normally cause the piston 34 to move to its close position. To effect this result, the valve plunger 58, which is disposed in the bias pressure circuit downstream of orifice 54, is adjusted to engage seat **57*b* when the idle speed pump pressure is 70 p.s.i. or below, and thus, prevent fuel flow past the plunger and into cavity 38 with the result that bias pressure drops to zero. When this latter condition occurs, the bias spring 35 located in bore 33, will force piston 34** to its left or open position.

The cold idle cracking pressure of piston 34 may be tuned to the required pressure by changing the by-pass orifice 51 until the correct ratio is obtained between the by-pass orifice 51 and the outlet orifice 66.

Thus, it will be noted that an improved system for controlling fuel flow in a multi-cylinder internal combustion engine has been provided which (a) effectively reduces hydrocarbon emissions when the engine is cold; (b) reduces hydrocarbon emissions to well below (25-50%) the limits imposed by CARB (California Air Review Board) and EPA (Environmental Protection Agency) at light load or no load conditions at any engine speed by permitting the cracking pressure of the valve piston 34 to vary with engine speed; (c) allows the valve piston to be calibrated to a specific cracking pressure at torque peak and at rated engine speeds; and (d) provides lubrication for various components of selected cylinders when the latter are not operating. The improved system is of simple design and may be readily installed on new or used engines.

We claim:

1. A system for controlling fuel flow within an internal combustion engine having a plurality of cylinders, said system comprising a fuel source; a fuel pump responsive to the speed of the engine and having an inlet connected to said fuel source, a first outlet connected to a first fuel supply line for a predetermined number of first cylinders, and a second outlet; and a multi-mode adjustable control valve having a housing provided with a first port connected to a drain communicating with the fuel source, a second port connected to the second outlet of said fuel pump, a third port connected to the first fuel supply line, and a fourth port connected to a second fuel supply line for a predetermined number of second cylinders; said control valve, when the engine is operating below a predetermined first speed and/or below a predetermined operating temperature, automatically assuming a first mode wherein fuel flow to the second cylinders is substantially cut off except for a predetermined restrictive amount of fuel flow thereto under a predetermined low pressure to effect continuous lubrication of said second cylinders, and when the engine is operating above said predetermined operating temperature, the control valve automatically assumes a second mode wherein there is substantially unrestricted fuel flow to the second cylinders.

2. The system of claim 1 wherein the pressure of the leaking fuel is substantially less than the pressure of the fuel in the first fuel supply line.

3. The system of claim 1 wherein the control valve includes a first piston means slidably mounted within the control valve housing for movement between first and second terminal positions, said piston means being provided with external means whereby upon said piston means assuming said first terminal position and said control valve being in said first mode communication between the third and fourth ports is substantially blocked while said external means simultaneously effects predetermined restrictive communication between the first and fourth ports and a continuous, restricted fuel flow to the second cylinders; said piston means upon assuming said second terminal position and said control valve being in said second mode effecting substantially unrestricted communication between said third and fourth ports.

4. The system of claim 3 wherein said control valve includes an adjustable stop for presetting the first terminal position of said first piston means within the control valve housing.

5. The system of claim 4 wherein said control valve includes biasing means disposed within said housing and interposed the adjustable stop and said piston means, said biasing means exerting a predetermined pressure on said piston means to assume said second terminal position.

6. The system of claim 3 wherein the control valve housing is provided with a first passageway having one end thereof communicating with the second port and the opposite end thereof communicating with an end of said first piston means; and an adjustable first valve disposed intermediate the ends of said first passageway and biased to assume an open position, the adjustment of said first valve to a close position being responsive to the engine operating temperature reaching the predetermined amount.

7. The system of claim 6 wherein the first passageway is provided with a pressure-reducing orifice.

8. The system of claim 6 wherein the control valve housing is provided with a second passageway having one end thereof communicating with the second port and the opposite end thereof communicating with a cavity formed in said housing, said cavity having an outlet communicating with an end of the first piston means and with the first port of the housing; and a second piston means slidably disposed within said cavity for movement between open and close positions, said second piston means being biased to assume the close position whereby said second passageway is closed off, and when in said open position, effecting substantial communication between said second port and said cavity whereby the first piston assumes said first terminal position and fuel flows substantially from said cavity to said first port.

9. The system of claim 8 wherein the first port of the control valve housing is provided with a check valve which assumes an open position only when the fuel pressure upstream of the check valve is above a predetermined low pressure; said low pressure being substantially less than the fuel pressure at the second outlet of said fuel pump.

10. The system of claim 9 wherein the check valve is provided with adjustable means for varying the opening of said valve in response to predetermined upstream fuel pressures.

11. The system of claim 6 wherein the second passageway is provided with a pressure-reducing orifice disposed upstream of the second piston means.

* * * * *